United States Patent [19]

Mattei et al.

[11] Patent Number: 4,875,493

[45] Date of Patent: Oct. 24, 1989

[54] DEVICE FOR FEEDING STREAMS OF TOBACCO ON TO A CIGARETTE MANUFACTURING MACHINE

[75] Inventors: Riccardo Mattei; Franco Ghini, both of Bologna, Italy

[73] Assignee: G. D. Societa' Per Azioni, Bolonga, Italy

[21] Appl. No.: 256,711

[22] Filed: Oct. 12, 1988

[30] Foreign Application Priority Data

Oct. 20, 1987 [IT] Italy ..... 3660 A/87

[51] Int. Cl.[4] ..... A24C 5/14

[52] U.S. Cl. ..... 131/84.1; 131/84.3; 131/109.1

[58] Field of Search ..... 131/84.1, 109.1

[56] References Cited

U.S. PATENT DOCUMENTS

| | | | |
|---|---|---|---|
| 1,705,012 | 3/1925 | Grupe | 131/84.1 |
| 3,871,385 | 3/1975 | David | 131/109.1 |
| 4,175,570 | 11/1979 | Heitmann | 131/84.3 |
| 4,372,326 | 2/1983 | Serganoli | 131/84 B |
| 4,510,949 | 4/1985 | Preston et al. | 131/109.1 |
| 4,570,644 | 2/1986 | Ahern et al. | 131/109.1 |
| 4,754,765 | 7/1988 | Brackmann et al. | 131/84.1 X |

*Primary Examiner*—V. Millin
*Assistant Examiner*—David F. Crosby
*Attorney, Agent, or Firm*—Marshall, O'Toole, Gerstein, Murray & Bickness

[57] ABSTRACT

A device for feeding streams of tobacco on to a cigarette manufacturing machine, which device presents an up-flow input duct, two up-flow output channels connected to the top end of the input duct via a chamber, and a device for dividing the input tobacco stream flowing up duct into two output streams, and feeding each to a respective up-flow channel; the separating device being located in the vicinity of chamber and featuring two conveyors, each located between the top end of input duct and the bottom end of a respective output channel; both conveyors presenting tobacco transporting means moving in the same direction and at substantially the same speed as the tobacco stream flowing up input duct.

8 Claims, 1 Drawing Sheet

DEVICE FOR FEEDING STREAMS OF TOBACCO ON TO A CIGARETTE MANUFACTURING MACHINE

BACKGROUND OF THE INVENTION

The present invention relates to a device for feeding streams of tobacco on to a cigarette manufacturing machine.

The device according to the present invention is particularly suitable for use on dual-rod cigarette manufacturing machines, especially as described in U.S. Pat. No. 4.372.326 filed by the present Applicant, G.D. S.p.A.

On said cigarette manufacturing machine, a continuous stream of shredded tobacco particles is fed into the bottom end of an up-flow input duct, which comes out at the top inside two up-flow output channels terminating beneath a respective suction type conveyor travelling in a given direction, and separated by a wall comprising a downward-facing wedge-shaped bottom portion facing the top end of the up-flow duct. The bottom end of the dividing wall is usually provided with means for separating and feeding the tobacco particles up into the up-flow channels.

In actual use, the tobacco particles travelling along the up-flow duct are fed, with no change in direction, through a chamber between the up-flow duct and up-flow channels, and, on encountering said separating means, are fed into one or other of said up-flow channels. A major drawback of the aforementioned feeding device is that the relatively high speed at which the tobacco particles encounter said separating means results in further shredding of the tobacco particles and almost complete removal of the so-called "long" filaments on which ultimate cohesion of the tobacco in the finished cigarette depends.

SUMMARY OF THE INVENTION

The aim of the present invention is to provide a device for feeding streams of shredded tobacco particles on to a cigarette manufacturing machine, and designed to overcome the aforementioned drawback.

With this aim in view, according to the present invention, there is provided a device for feeding streams of tobacco on to a cigarette manufacturing machine, said device comprising an up-flow input duct, two up-flow output channels, a chamber connecting the top end of said input duct to the bottom end of each said output channel, and a device for dividing the input tobacco stream flowing up said input duct into two output streams, and feeding each said output stream to a respective said output channel; characterised by the fact that said separating device comprises two conveyors in the vicinity of said chamber, each located between the top end of said input duct and the bottom end of a respective said output channel; both said conveyors presenting tobacco transporting means substantially closing off the top end of said input duct, and travelling in the same direction and at substantially the same speed as the tobacco flowing up said input duct.

BRIEF DESCRIPTION OF THE DRAWINGS

The present invention will be described with reference to the accompanying drawings, in which.

DETAILED DESCRIPTION OF THE INVENTION

Figure 1:
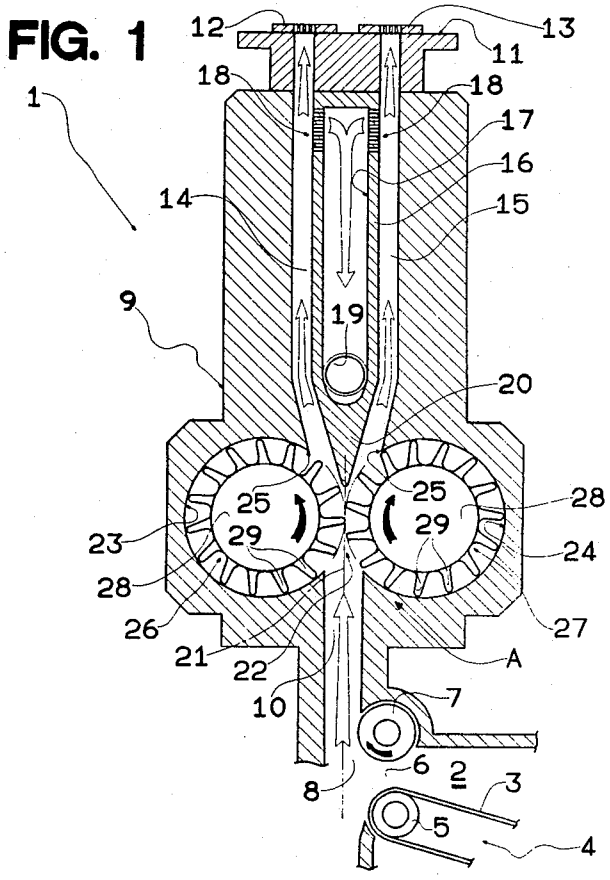

Number 1 in FIG. 1 indicates a cigarette manufacturing machine having an internal chamber 2, the bottom of which is defined by the top branch 3 of a conveyor belt 4 looped about rollers 5 (only one of which is shown).

Said branch 3 is designed to receive a stream of shredded tobacco from a known type of carding unit (not shown), and feed it into chamber 8 through a passage 6 defined between one of rollers 5 and a counter-rotating top roller 7.

Number 9 indicates a tobacco feeding device, hereinafter referred to as "column" 9, arranged substantially vertically and housing an up-flow duct 10 communicating at the bottom end with chamber 8.

Column 9 constitutes the output unit of machine 1, and is defined at the top by a surface 11 supporting, in sliding manner, two suction type conveyors 12 and 13 travelling substantially perpendicularly in relation to the FIG. 1 plane.

Duct 10 is fed at the bottom end with shredded tobacco off conveyor 4 and, in turn, feeds two up-flow channels 14 and 15 arranged side by side and transversely in relation to the travelling direction of conveyors 12 and 13.

Inside column 9, channels 14 and 15 are separated by a substantially vertical wall 16 housing a cavity 17, which communicates, at the top, with each of channels 14 and 15 via a number of holes 18, and, at the bottom, with a suction duct 19.

The bottom end of wall 16 presents a wedge 20, the bottom tip of which extends along center line 21 of duct 10 into a chamber 22 between the top end of duct 10 and the bottom end of channels 14 and 15.

Chamber 22 is assigned a device A for dividing a stream of tobacco into two separate streams, and comprising two cavities, 23 and 24, formed inside column 9 and on opposite sides of, and symmetrically in relation to, center line 21. Each of cavities 23 and 24 is substantially cylindrical, with its axis perpendicular to center line 21 and the FIG. 1 plane, and communicates laterally with chamber 22 via a respective opening 25.

Device A also comprises two rotary conveyors 26 and 27 partially housed inside cavities 23 and 24 and projecting radially from the same into chamber 22 via respective openings 25. Conveyors 26 and 27 substantially close off the top end of duct 10, and are located between duct 10 and the bottom end of respective channels 14 and 15.

Each of conveyors 26 and 27 comprises a central rotary shaft 28 coaxial with respective cavity 23 and 24, and a number of tobacco transporting elements extending outwards of respective shaft 28 and into chamber 22. In the FIG. 1 example, said transporting elements consist of substantially radial blades 29, the outer ends of which are turned by respective shaft 28 so as to describe a circle tangent to center line 21.

According to a variation (not shown), blades 29 are replaced by rows of needles of the same length.

In actual use, shafts 28 are turned so that the ends of blades 29 travel through chamber 22 at substantially the same speed and in the same direction as the tobacco particles flowing up duct 10. For this purpose, in the FIG. 1 example, shafts 28 of conveyors 26 and 27 are turned anticlockwise and clockwise respectively, so that the tobacco particles flowing up duct 10 are intercepted and fed by repsective blades 29 into respective channels 14 and 15, without being stopped and, in particular, without being damaged by impact against blades 29 or wedge 20.

If necessary, tobacco feed into channels 14 and 15 may be controlled by mutually adjusting the speed of shafts 28. In actual practice, said speed adjustment is obviously very small.

Figure 2:
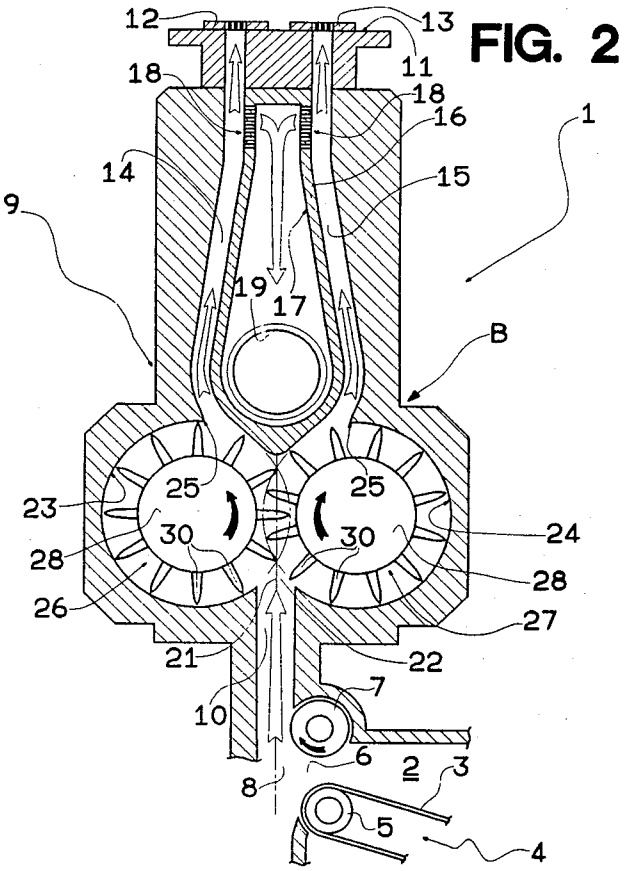
FIGS. 1 and 2 show schematic sections of two lon-limiting embodiments of the device according to the present invention.

In the FIG. 2 embodiment, device A is replaced by device B, the corresponding component parts of which are indicated using the same numbering system, and which differs solely and substantially by virtue of comprising, in lieu of blades 29, rows by needles 30, the free ends of which describe a circular trajectory which, in the FIG. 2 plane, intersects center line 21 at two points. Conveyors 26 and 27 thus interact with each other, and, for enabling mutual speed adjustment of shafts 28, said rows of needles 30 on respective shafts 28 are offset perpendicularly in relation to the FIG. 2 plane.

What is claimed is:

1. A device for feeding streams of tobacco on to a cigarette manufacturing machine (1), said device (9) comprising an up-flow input duct (10), two up-flow output channels (14, 15), a chamber (22) connecting the top end of said input duct (10) to the bottom end of each said output channel (14, 15), and a device (A or B) for dividing the input tobacco stream flowing up said input duct (10) into two output streams, and feeding each said output stream to a respective said output channel (14, 15); characterised by the fact that said separating device (A or B) comprises two conveyors (26, 27) in the vicinity of said chamber (22), each located between the top end of said input duct (10) and the bottom end of a respective said output channel (14, 15); both said conveyors (26, 27) presenting tobacco transporting means (29 or 30) substantially closing off the top end of said input duct (10), and travelling in the same direction and at substantially the same speed as the tobacco flowing up said input duct (10).

2. A device as claimed in claim 1, characterised by the fact that it comprises two cavities (23, 24) communicating laterally with said chamber (22) and each partially housing a respective said conveyor (26, 27).

3. A device as claimed in claim 2, characterised by the fact that each said conveyor (26, 27) is a rotary conveyor partially housed inside a respective said cavity (23, 24) and transporting means projecting radially from the rotary conveyor into said chamber (22).

4. A device as claimed in claim 3, characterised by the fact that each said conveyor (26, 27) comprises a central rotary shaft (28), and a number of tobacco transporting elements (29 or 30) extending substantially radially outwards of the respective said shaft (28) into said chamber (22).

5. A device as claimed in claim 4, characterised by the fact that rotation of the respective said shaft (28) causes the free ends of said transporting elements (29) to describe a circular trajectory substantially tangent to the center line (21) of said input duct (10).

6. A device as claimed in claim 4, characterised by the fact that rotation of the respective said shaft (28) causes the free ends of said transporting elements (30) to describe a circular trajectory intersecting the center line (21) of said input duct at two points.

7. A device as claimed in claim 4, characterised by the fact that said transporting elements consist of blades (29).

8. A device as claimed in claim 4, characterised by the fact that said transporting elements consist of needles (30).

* * * * *